US009841699B2

(12) United States Patent
Koga

(10) Patent No.: US 9,841,699 B2
(45) Date of Patent: Dec. 12, 2017

(54) OPTICAL SCANNING APPARATUS AND IMAGE FORMING APPARATUS

(71) Applicant: CANON KABUSHIKI KAISHA, Tokyo (JP)

(72) Inventor: Katsuhide Koga, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/220,285

(22) Filed: Jul. 26, 2016

(65) Prior Publication Data

US 2016/0334731 A1 Nov. 17, 2016

Related U.S. Application Data

(63) Continuation of application No. 13/685,271, filed on Nov. 26, 2012, now Pat. No. 9,740,136.

(30) Foreign Application Priority Data

Nov. 14, 2012 (JP) ..... 2012-250587

(51) Int. Cl.
*G03G 15/043* (2006.01)
*G03G 15/02* (2006.01)

(52) U.S. Cl.
CPC ..... *G03G 15/043* (2013.01); *G03G 15/0266* (2013.01)

(58) Field of Classification Search
CPC ..... G03G 15/043; G03G 15/0266
(Continued)

(56) References Cited

U.S. PATENT DOCUMENTS 4,870,633 A 9/1989 Matsushita et al.
6,222,580 B1 4/2001 Yamada
(Continued)

FOREIGN PATENT DOCUMENTS

CN 101135876 3/2008
JP 07-171995 7/1995
(Continued)

OTHER PUBLICATIONS

Chinese Office Action dated Sep. 2, 2014 in counterpart Chinese Patent Application No. 201210524710.5 and English language translation.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

An optical scanning apparatus according to one aspect of this invention includes a light source that outputs a light beam having a light power based on a supplied driving current, a detection unit that detects the light power of the light beam, and a voltage holding unit that holds a charged voltage used to control the driving current. The optical scanning apparatus further includes a control unit that controls a charging unit so that the voltage holding unit is charged in a state where the driving current is not supplied to the light source, and controls the charging unit based on a detection result of the detection unit so that the voltage held in the voltage holding unit is controlled from the voltage of the voltage holding unit charged in the state where the driving current is not supplied to the light source.

6 Claims, 8 Drawing Sheets

(58) Field of Classification Search
USPC ..... 347/236
See application file for complete search history.

(56) References Cited

U.S. PATENT DOCUMENTS

| | | | | |
|---|---|---|---|---|
| 6,266,078 | B1 * | 7/2001 | Koga ..... | G02B 26/123 250/205 |
| 6,396,858 | B2 | 5/2002 | Kawakami et al. | |
| 6,919,979 | B2 | 7/2005 | Seki et al. | |
| 7,170,536 | B2 | 1/2007 | Inagawa et al. | |
| 7,268,797 | B2 | 9/2007 | Hata et al. | |
| 7,633,515 | B2 | 12/2009 | Tomioka | |
| 7,746,370 | B2 | 6/2010 | Hata et al. | |
| 7,760,222 | B2 | 7/2010 | Maeda | |
| 7,782,511 | B2 | 8/2010 | Otoguro | |
| 8,120,633 | B2 | 2/2012 | Koga | |
| 8,957,932 | B2 | 2/2015 | Koga | |
| 2004/0124788 | A1 | 7/2004 | Ohmori | |
| 2006/0050139 | A1 | 3/2006 | Inagawa et al. | |
| 2008/0049797 | A1 | 2/2008 | Morisawa et al. | |
| 2008/0158634 | A1 | 7/2008 | Otoguro | |
| 2011/0080624 | A1 | 4/2011 | Ku | |
| 2011/0134501 | A1 | 6/2011 | Motoyama et al. | |
| 2013/0147891 | A1 | 6/2013 | Koga | |
| 2013/0162746 | A1 | 6/2013 | Akagi | |

FOREIGN PATENT DOCUMENTS

| | | | |
|---|---|---|---|
| JP | H10-093171 | A | 4/1998 |
| JP | H10-190115 | A | 7/1998 |
| JP | 11-123845 | | 5/1999 |
| JP | 2001-024273 | | 1/2001 |

* cited by examiner

OPTICAL SCANNING APPARATUS AND IMAGE FORMING APPARATUS

CROSS-REFERENCE TO RELATED APPLICATIONS

This application is a continuation of U.S. application Ser. No. 13/685,271 filed Nov. 26, 2012, now pending, the contents of which are incorporated by reference as if set forth in full herein; and claims the benefit of Japanese Patent Application Nos. 2011-269394, filed Dec. 8, 2011 and 2012-250587, filed Nov. 14, 2012, which are incorporated by reference herein in their entirety.

BACKGROUND OF THE INVENTION

Field of the Invention

The present invention relates to an optical scanning apparatus and an image forming apparatus that uses the optical scanning apparatus.

Description of the Related Art

An electrophotographic image forming apparatus develops an electrostatic latent image formed on a photosensitive member by a toner and transfers and fixes the developed toner image to a recording material, thereby forming an image on the recording material. To form the electrostatic latent image on the photosensitive member, the image forming apparatus uses an optical scanning apparatus. The optical scanning apparatus includes a laser light source that emits a laser beam, and a deflector such as a rotating polygon mirror that deflects the laser beam emitted by the laser light source so that the laser beam scans the surface of the photosensitive member in a predetermined direction. To control the light power of the laser beam scanning the surface of the photosensitive member to a target light power, the image forming apparatus executes APC (Automatic Power Control).

In the APC, the light power of the laser beam emitted by the laser light source is detected using an optical sensor such as a photodiode. A driving current to be supplied to the laser light source is gradually adjusted such that the detected light power of the laser beam reaches the target light power.

The APC includes initial APC executed as an initial operation for making preparations for image formation and normal APC executed during image formation. The normal APC is to control the light power of the laser beam during, for example, the period of scanning the surface of the photosensitive member. On the other hand, the initial APC is to perform control to decide the value of the driving current to be supplied to the laser light source in a non-turn-on state as an initial operation when image data is input to the image forming apparatus.

Japanese Patent Laid-Open No. 7-171995 describes the initial APC. The light emission amount of a laser light source relative to a supplied driving current changes depending on the temperature of the light-emitting element or the time-rate change of the laser light source. To prevent the laser light source from being damaged by an excessive driving current supplied to it at the time of initial APC, Japanese Patent Laid-Open No. 7-171995 discloses initial APC that increases the driving current to be supplied to the laser light source stepwise from 0, thereby controlling the laser beam to the target light power.

However, since the initial APC described in Japanese Patent Laid-Open No. 7-171995 executes the step of increasing the driving current stepwise, a problem is posed that a control time that is relatively long is necessary after the start of the initial APC until the light power of the laser light source stabilizes near the target light power, and image formation can be started.

In particular, in a multi-beam system using a plurality of laser light sources, the initial APC is performed first for a specific laser light source to be used to generate a synchronization signal (to be referred to as a BD signal hereinafter) to define the image write position. After the light power has approached the target light power, the APC is started for the remaining laser light sources. For the remaining laser light sources, the APC needs to be performed at a timing so as not to cause the laser beam deflected by a polygon mirror to expose the photosensitive member. To detect such a timing, the light power of the laser beam to be used to generate the BD signal needs to be adjusted to a light power that allows BD signal generation. That is, after the initial APC has been performed for the specific laser light source, the initial APC is performed for the remaining laser light sources. Hence, the time after the light power has been made to approach the target light power by the initial APC until image formation can be started for all laser light sources including the specific laser light source and the remaining laser light sources further prolongs as compared to the case in which a single laser light source is used. Hence, there is deemed necessary a technique of shortening the time after the start of initial APC until the light power of the laser light source approaches the target light power.

SUMMARY OF THE INVENTION

The present invention has been made in consideration of the above-described problem. The present invention provides a technique of enabling the light power of a laser light source to approach a target light power in a short time after turning on the laser light source when executing APC in an optical scanning apparatus.

According to a first aspect of the present invention, there is provided an optical scanning apparatus, for scanning a photosensitive member with a light beam, comprising: a light source configured to output the light beam having a light power dependent on a value of a driving current; a detection unit configured to detect the light power of the light beam output from the light source; a voltage holding unit configured to hold a voltage; a charging unit configured to charge the voltage holding unit; and a control unit configured to control the charging unit so that the voltage holding unit is charged by the charging unit and configured to control the value of the driving current, wherein the control unit controls the charging unit so that the voltage holding unit is charged by the charging unit in a state where the driving current is not supplied to the light source, controls the charging unit based on a detection result of the detection unit so that the voltage held in the voltage holding unit is controlled from the voltage of the voltage holding unit charged in the state where the driving current is not supplied to the light source, and controls the value of the driving current based on the voltage held in the voltage holding unit controlled by the control unit.

According to a second aspect of the present invention, there is provided an image forming apparatus, comprising: a photosensitive member; a charger that charges the photosensitive member; an optical scanning apparatus configured to that scan the photosensitive member with a light beam output from a light source when a driving current modulated based on image information is supplied to the light source; a developer configured to develop an electrostatic latent image formed on the photosensitive member by scanning of the light beam by the optical scanning apparatus to form an image on the photosensitive member, and a control unit configured to control the optical scanning apparatus, wherein the optical scanning apparatus comprises: the light source configured to output the light beam having a light power dependent on a value of the driving current; a detection unit configured to detect the light power of the light beam output from the light source; a voltage holding unit configured to hold a voltage; and a charging unit configured to charge the voltage holding unit, wherein the control unit controls the charging unit so that the voltage holding unit is charged by the charging unit and controls the value of the driving current, and wherein the control unit controls the charging unit so that the voltage holding unit is charged by the charging unit in a state where the driving current is not supplied to the light source, controls the charging unit based on a detection result of the detection unit so that the voltage held in the voltage holding unit is controlled from the voltage of the voltage holding unit charged in the state where the driving current is not supplied to the light source, and controls the value of the driving current based on the voltage held in the voltage holding unit controlled by the control unit.

According to the present invention, it is possible to provide a technique of enabling the light power of a light source to approach a target light power in a short time after turning on the light source when executing APC in an optical scanning apparatus.

Further features of the present invention will become apparent from the following description of embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention. Each of the embodiments of the present invention described below can be implemented solely or as a combination of a plurality of the embodiments or features thereof where necessary or where the combination of elements or features from individual embodiments in a single embodiment is beneficial.

<Arrangement of Image Forming Apparatus 100>

Figure 1:
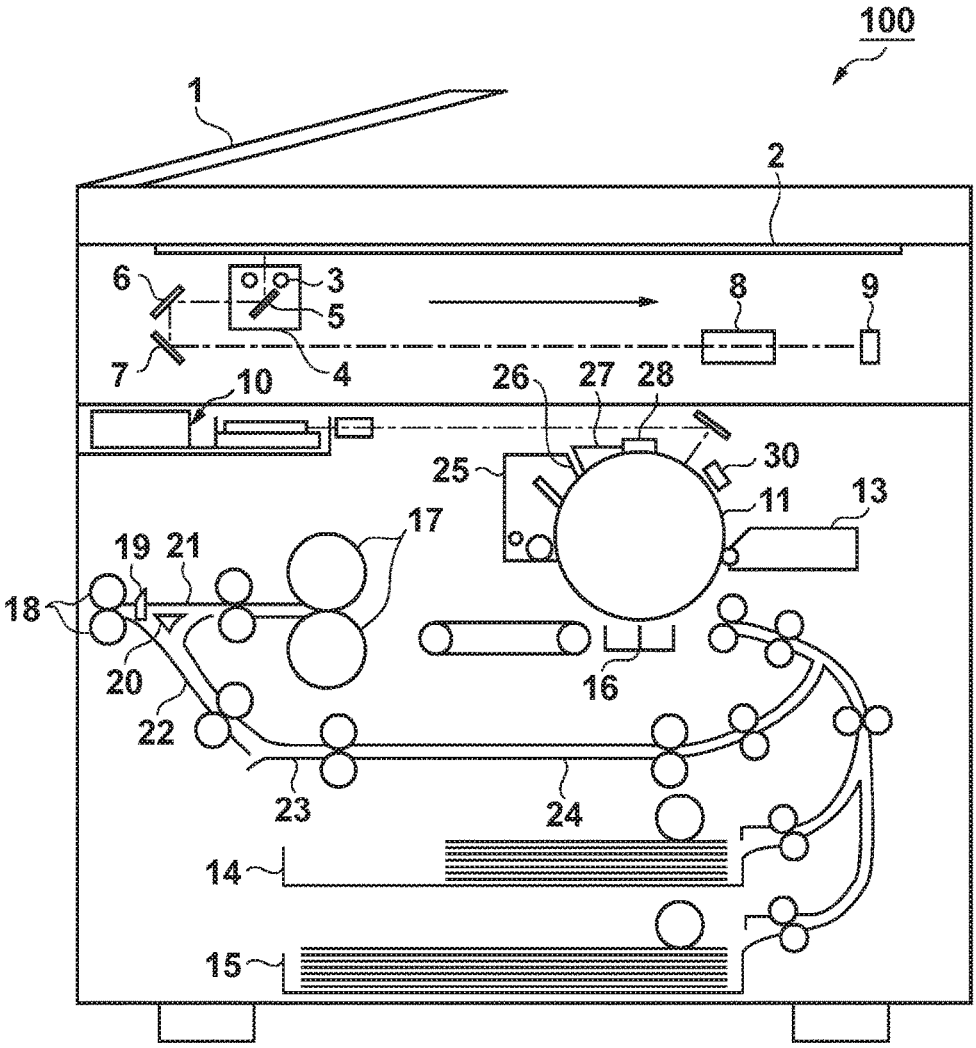
FIG. 1 is a schematic sectional view of an image forming apparatus 100 according to the embodiment of the present invention.

The basic operation of an optical scanning apparatus and an image forming apparatus according to an embodiment will be described first with reference to FIG. 1. FIG. 1 is a schematic sectional view of an image forming apparatus 100 according to this embodiment.

In the image forming apparatus 100, documents stacked on a document feeder 1 are sequentially conveyed onto the surface of a platen glass 2 one by one. When the document is conveyed onto the surface of the platen glass 2, a lamp unit 3 of a reading unit 4 is turned on, and the reading unit 4 irradiates the document with light while moving in the direction of an arrow 110. The light reflected by the document passes through a lens 8 via mirrors 5, 6, and 7 and is then input to an image sensor unit 9 and converted into an image signal. The image signal output from the image sensor unit 9 is temporarily stored in an image memory (not shown). After that, the image signal is read out from the image memory and input to an exposure controller 10.

The exposure controller 10 causes a laser light source to be described later to emit a laser beam (light beam) to expose the surface of a photosensitive member 11 (for example, photosensitive drum) based on the input image signal (image information). The photosensitive member 11 is scanned by the laser beam emitted by the laser light source. When the photosensitive member 11 is scanned by the laser beam, an electrostatic latent image is formed on its surface. A potential sensor 30 detects the surface potential of the photosensitive member 11 and simultaneously monitors whether the surface potential has a desired value. A developer 13 develops the electrostatic latent image formed on the surface of the photosensitive member 11 by a toner. A transfer unit 16 transfers the toner image developed by the developer 13 to the surface of a recording material.

The recording material to which the toner image is to be transferred by the transfer unit 16 is fed and conveyed from a recording material stacking unit 14 or 15 in synchronization with a timing at which the toner image reaches the transfer unit 16. The recording material to which the toner image has been transferred by the transfer unit 16 is conveyed to a fixing unit 17. The fixing unit 17 fixes the toner image on the surface of the recording material. After the fixing processing by the fixing unit 17, the recording material is discharged from a discharge unit 18 to the outside of the image forming apparatus 100.

After the transfer by the transfer unit 16 has been done, a cleaner 25 collects the toner remaining on the surface of the photosensitive member 11, thereby cleaning the surface of the photosensitive member 11. Next, an auxiliary charger 26 removes charges from the surface of the photosensitive member 11 so that the photosensitive member 11 can obtain a satisfactory charge characteristic upon charging by a primary charger 28 at the next time of image formation. In addition, after the residual charges on the surface of the photosensitive member 11 are removed by a pre-exposure lamp 27, the primary charger 28 charges the surface of the photosensitive member 11. The image forming apparatus 100 executes image formation for a plurality of recording materials by repeating the above-described processing.

<Arrangement of Exposure Controller 10>

Figure 2:
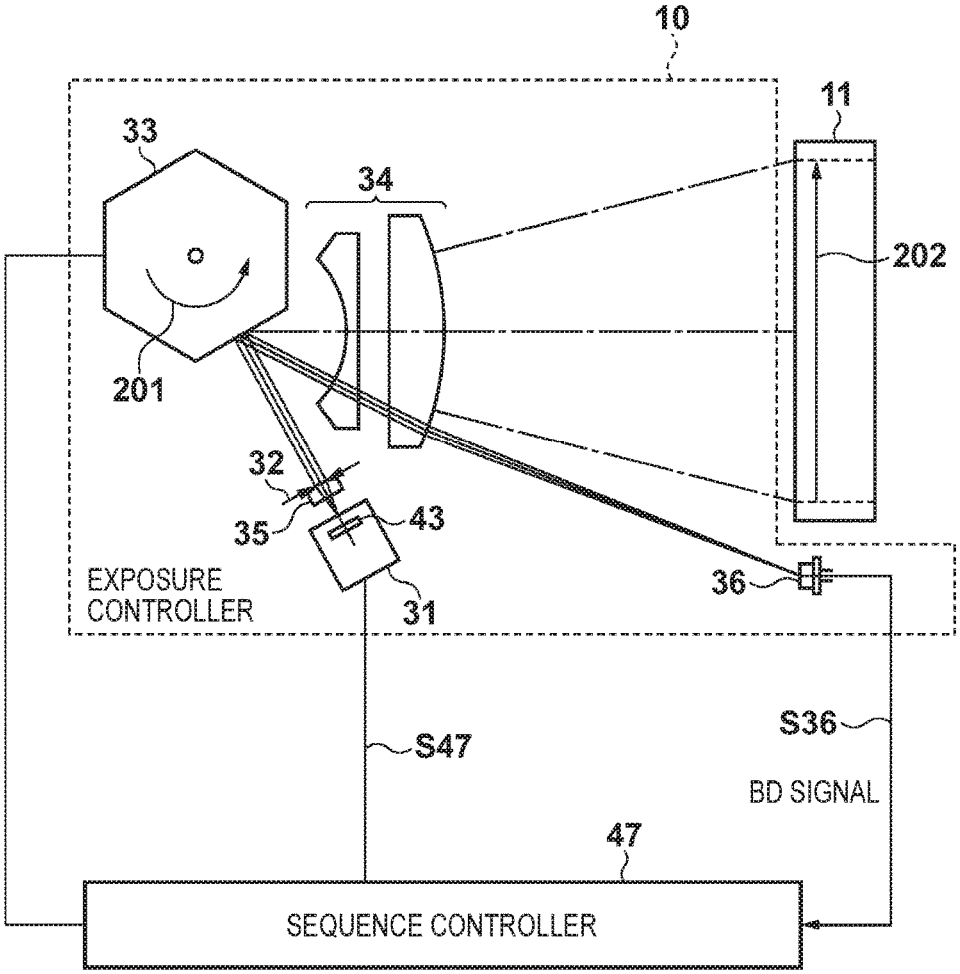
FIG. 2 is a view showing the arrangement of an exposure controller 10 according to the embodiment of the present invention and the connection relationship between the exposure controller 10 and a sequence controller 47.

FIG. 2 is a view showing the schematic arrangement of the exposure controller 10 according to this embodiment and connection between the exposure controller 10 and a sequence controller 47. The sequence controller 47 includes a CPU (not shown), and the CPU controls the exposure controller 10 and the photosensitive member 11. As shown in FIG. 2, the exposure controller 10 includes a laser driving device 31, a collimator lens 35, a stop 32, a polygon mirror 33, an f-θ lens 34, and a BD (Beam Detect) sensor 36. The laser driving device 31 includes a semiconductor laser (laser diode (LD)) 43 including a plurality of light-emitting points for emitting laser beams, and one photodiode (PD).

The operation of the exposure controller 10 based on the control of the sequence controller 47 will be described next. The sequence controller 47 included in the image forming apparatus 100 controls the laser driving device 31 using a control signal S47 output to the laser driving device 31. When image formation starts, the sequence controller 47 controls each light-emitting point of the semiconductor laser 43 to a turn-on state or a turn-off state based on the control signal S47. Each laser beam emitted by the semiconductor laser 43 is converted into a substantially collimated light beam via the collimator lens 35 and the stop 32, and then enters the polygon mirror 33 in a predetermined spot diameter.

The polygon mirror 33 has a plurality of mirror surfaces and rotates in the direction of an arrow 201 at a uniform angular velocity. Along with the rotation in the direction of the arrow 201, the polygon mirror 33 reflects each laser beam so that the laser beams that have entered are deflected at continuous angles. Each laser beam deflected by the polygon mirror 33 enters the f-θ lens 34. The f-θ lens 34 applies a condenser effect to the plurality of laser beams that have entered, and corrects distortion to guarantee temporal linearity when the plurality of laser beams scan the surface of the photosensitive member 11. The plurality of laser beams scan the surface of the photosensitive member 11 in the direction of an arrow 202 at a uniform velocity.

The BD sensor 36 is a sensor used to detect a laser beam reflected by the polygon mirror 33. The BD sensor 36 detects a laser beam emitted by a specific light-emitting point out of the laser beams reflected by the mirror surfaces of the polygon mirror 33. That is, the sequence controller 47 controls the specific light-emitting point so that the laser beam emitted by the specific light-emitting point scans the BD sensor 36. Upon detecting the laser beam, the BD sensor 36 outputs a synchronization signal (BD signal) S36 indicating the detection of the laser beam to the sequence controller 47. The sequence controller 47 controls the turn-on timing of each light-emitting point based on image data using the BD signal S36 as a reference.

The sequence controller 47 monitors the period of output of the BD signal S36 from the BD sensor 36, thereby monitoring the period of laser beam detection by the BD sensor 36. In addition, the sequence controller 47 controls to accelerate or decelerate a polygon mirror driver (not shown) for driving the polygon mirror 33 such that the period of one rotation of the polygon mirror 33 is always constant. By this control, the sequence controller 47 sets the polygon mirror 33 in a stable rotation state.

<Arrangement of Laser Driving Device 31>

The arrangements of the laser driving device 31 and an APC circuit 403 (APC circuits 403-1 to **403-*n*) included in the laser driving device 31 will be described next with reference to FIGS. 3A and 3B. The arrangement of the laser driving device 31 will be described first with reference to FIG. 3**A.

The laser driving device 31 includes the semiconductor laser 43. The semiconductor laser 43 includes a plurality of (n) light-emitting points (LD1 to LDn) and one photodiode (PD). The laser driving device 31 is also provided with the plurality of APC circuits 403-1 to **403-*n* in correspondence with the plurality of light-emitting points (LD1** to LDn).

The PD in the semiconductor laser 43 detects a laser beam from each of the LD1 to LDn, and outputs a current Im corresponding to the detected light power to a current/voltage converter 401. The current/voltage converter 401 converts the received current Im into a voltage and outputs it. An amplifier 402 is used to adjust the gain of the voltage output from the current/voltage converter 401. That is, the amplifier 402 adjusts the gain of the output from the PD that has detected the laser beam from each of the LD1 to LDn. The voltage that has undergone the gain adjustment by the amplifier 402 is supplied from the amplifier 402 to the APC circuit 403 as a light power monitor voltage Vpd. Note that the PD, the current/voltage converter 401, and the amplifier 402 in the semiconductor laser 43 are provided to detect the light power of a laser beam output from each light-emitting point.

The laser driving device 31 is controlled by the sequence controller 47 based on various kinds of control signals included in the control signal S47 output from the sequence controller 47, as described above. The control signal S47 includes, for example, a full turn-on signal FULL to be supplied to a logical element 412, a control signal OFF_LD to be supplied to switches 408-1 to **408-*n***, and control signals OFF_APC* (OFF_APC*-1 to OFF_APC*-n) and sample hold signals S/H* (S/H*-1 to S/H*-n) to be supplied to the APC circuits 403-1 to **403-*n*. The control signal S47 also includes a light power control signal to be output to a current controller 506** to be described later.

The control signal S47 (the control signals OFF_APC* and the sample hold signals S/H*) from the sequence controller 47 is input to the APC circuits 403-1 to **403-*n*. In addition to the control signal S47, a reference voltage Vref from the sequence controller 47 is input to the APC circuits 403-1 to 403-*n* via digital/analog conversion (D/A) circuits 417-1 to 417-*n*. The D/A circuits 417-1 to 417-*n* convert a digital value representing the reference voltage Vref input from the sequence controller 47 into an analog value and input it to the APC circuits 403-1 to 403-*n* as the reference voltage Vref, respectively. Under the control of the sequence controller 47, each of the APC circuits 403-1 to 403-*n* performs control to adjust the light power of a corresponding one of LDs (LD1 to LDn) so as to cause the plurality of LDs (LD1 to LDn) to emit light of a predetermined light power. Each of the APC circuits 403-1 to 403-*n* executes light power control of a corresponding LD based on the reference voltage Vref in accordance with the control signal S47 from the sequence controller 47**.

A modulator 413 outputs, to the logical element 412, an image modulation signal to be used to modulate driving currents to be supplied to the LD1 to LDn using an image signal (image information) input from an image signal generation unit (not shown) or the like. For example, to perform PWM (pulse width modulation) of a driving current, the modulator 413 outputs a pulse signal having a width corresponding to image data to the logical element 412 as an image modulation signal. The logical element 412 outputs, to switches 409-1 to **409-*n*, a signal representing the OR (logical addition) of the image modulation signal output from the modulator 413 and the full turn-on signal FULL output from the sequence controller 47**.

Figure 3A:
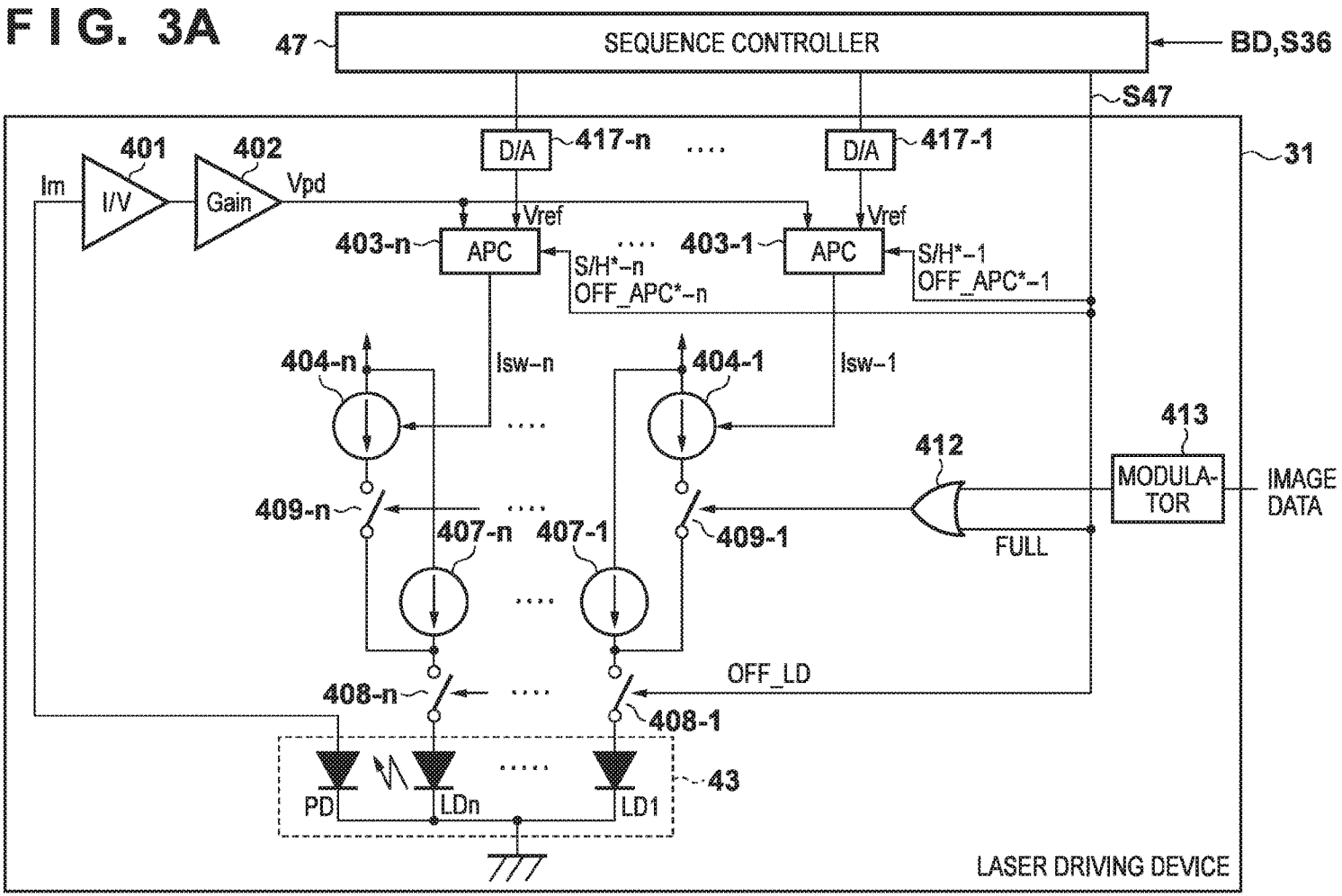
FIG. 3A is a block diagram showing the arrangement of a laser driving device 31 according to the embodiment of the present invention.
Figure 3B:
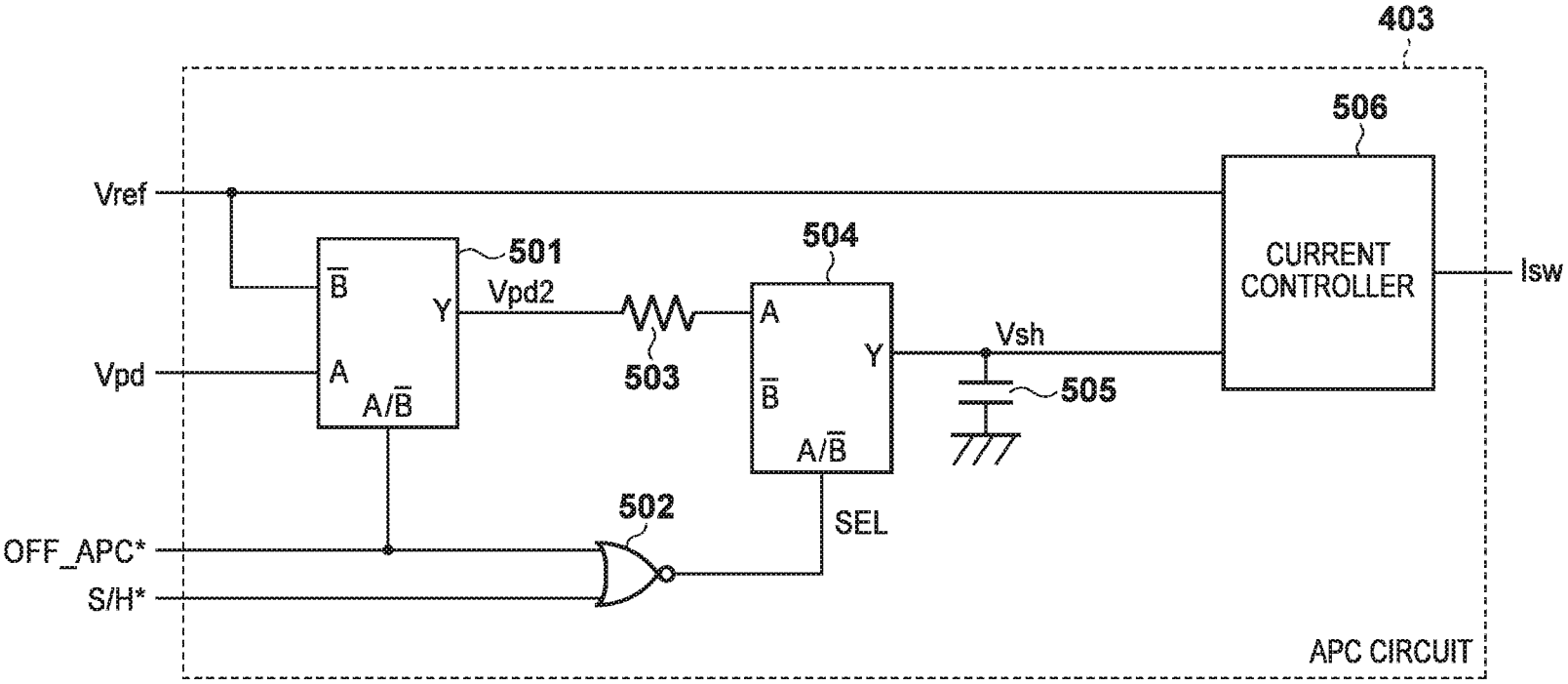
FIG. 3B is a block diagram showing the arrangement of an APC circuit 403 according to the embodiment of the present invention.

As shown in FIG. 3A, the laser driving device 31 includes current sources 404-1 to **404-*n* and 407-1 to 407-*n* for supplying (applying) driving currents to the LD1 to LDn in the semiconductor laser 43. The laser driving device 31 also includes the switches 408-1 to 408-*n* and 409-1 to 409-*n* that switch the current supply states from the current sources to the LD1 to LDn. For example, the driving current for the LD1 is supplied from the current sources 404-1 and 407-1, and the supply state is switched by the switches 408-1 and 409-1. The operations of the current sources 404-1 and 407-1 and the switches 408-1 and 409-1 corresponding to the LD1 out of the LD1 to LDn will mainly be described below. The description of LD1 also applies to the remaining lasers LD2** to LDn.

The switching current source 404-1 and the bias current source 407-1 for supplying a driving current to the LD1 are connected in parallel between the power supply and the LD1.

The bias current source 407-1 supplies a bias current to the LD1. The bias current is a current supplied to the LD1 to cause it to emit a laser beam of a light power that does not change the potential on the photosensitive member 11. When the switch 408-1 is turned on, the bias current source 407-1 supplies the bias current to the LD1. In a case in which the bias current is supplied to the LD1, the time until the light power reaches the target light power when supplying a switching current to be described below to the LD1 can be shortened as compared to a case in which no bias current is supplied to the LD1. That is, supplying the bias current to the LD1 enables to improve the light emission responsibility of the LD1 when the switching current is supplied. In this embodiment, a laser driving device for supplying a bias current having a predetermined value to the LD1 will be exemplified for the sake of descriptive simplicity.

The switching current source 404-1 supplies the switching current to the LD1. The switching current is a current supplied to the LD1 to cause it to emit a laser beam of a light power that changes the potential on the photosensitive member, and is supplied to the LD1 while being superimposed on the above-described bias current.

The APC circuit 403-1 controls the value of the current to be supplied from the switching current source 404-1 to the LD1 by a current control signal Isw-1 output to the switching current source 404-1. The switching current source 404-1 supplies a switching current corresponding to the current control signal Isw-1 given by the APC circuit 403-1 to the LD1 as a driving current. The switch 409-1 is connected between the LD1 and the switching current source 404-1. For this reason, driving current supply from the switching current source 404-1 to the LD1 is set to the on/off state in accordance with the on/off state of the switch 409-1.

The switch 408-1 is connected to the path from the switching current source 404-1 and the bias current source 407-1 to the LD1. The sequence controller 47 controls the switch 408-1 between the on and off states using the signal OFF_LD output to the switch 408-1. In this embodiment, if the signal OFF_LD output from the sequence controller 47 is in the high state ("H"), the switch 408-1 is turned off, and in the low state ("L"), the switch 408-1 is turned on. If the switch 408-1 is in the on state, the switching current source 404-1 and the bias current source 407-1 supply the currents to the LD1. On the other hand, if the switch 408-1 is in the off state, current supply from the switching current source 404-1 and the bias current source 407-1 to the LD1 is cut off.

When the switch 408-1 is in the on state, and the switch 409-1 is in the off state, the switching current is not supplied from the switching current source 404-1 to the LD1, and the bias current is supplied from the bias current source 407-1 to the LD1. Note that the switch 409-1 is controlled to the on or off state based on a signal supplied from the modulator 413 via the logical element 412.

When the switch 408-1 is in the on state, and the switch 409-1 is in the on state, the bias current from the bias current source 407-1 and the switching current from the switching current source 404-1 are supplied to the LD1 as the driving current. In this case, the LD1 outputs, to the surface of the photosensitive member 11, a laser beam of a light power necessary for forming an electrostatic latent image on the surface.

<Arrangement of APC Circuit 403 (403-1 to **403-*n***)>

The arrangement of the APC circuits 403-1 to **403-*n* included in the laser driving device 31 will be described next with reference to FIG. 3B. Each of the APC circuits 403-1 to 403-*n* performs APC for a corresponding one of the LDs (LD1 to LDn). For the sake of descriptive simplicity, APC by the APC circuit 403-1 for the LD1 will only be explained below. For the remaining lasers (LD2 to LDn) as well, the APC can be implemented by performing the same control as that of the LD1. Since all the APC circuits 403-1 to 403-*n* have the same arrangement, the APC circuits 403-1 to 403-*n* will be referred to as the APC circuit 403** hereinafter.

As described above, the reference voltage Vref corresponding to the target light power of the LD1 and the light power monitor voltage Vpd output from the amplifier 402 are input to the APC circuit 403. In addition, out of the control signal S47 output from the sequence controller 47, the control signal OFF_APC* and the sample hold signal S/H* are output to the APC circuit 403. In the APC circuit 403, the reference voltage Vref is supplied to an analog switch 501 and the current controller 506. The control signal OFF_APC* is supplied to the analog switch 501 and a logical element 502. The sample hold signal S/H* is supplied to the logical element 502.

The light power monitor voltage Vpd and the reference voltage Vref are input to the input side of the analog switch 501. One of the light power monitor voltage Vpd and the reference voltage Vref is output from the output side of the analog switch 501 as an output voltage Vpd2 based on the control signal OFF_APC* from the sequence controller 47. More specifically, if the control signal OFF_APC* is "H", the analog switch 501 outputs the light power monitor voltage Vpd as the output voltage Vpd2. If the control signal OFF_APC* is "L", the analog switch 501 outputs the reference voltage Vref as the output voltage Vpd2.

The logical element 502 is an element that outputs a signal generated by obtaining a signal representing the AND (logical product) of the received control signal OFF_APC* and sample hold signal S/H* and inverting the logic of the obtained signal (H→L or L→H), and corresponds to a NAND circuit. The signal output from the logical element 502 is supplied to an analog switch 504 as a control signal SEL.

The analog switch 504 functions as a sample hold circuit. The output voltage Vpd2 of the analog switch 501 is applied to the input side of the analog switch 504 via a resistive element 503. The analog switch 504 switches between a sample state and a hold state by switching based on the control signal SEL supplied from the logical element 502 whether to output, from the output side, the voltage input from the input side.

More specifically, if the control signal SEL is "H", the output-side terminal and the input-side terminal connected to the output-side terminal of the analog switch 501 are connected in the analog switch 504. The analog switch 504 thus outputs, from the output side, the voltage applied from the analog switch 501 to the input side via the resistive element 503. On the other hand, if the control signal SEL is "L", the analog switch 504 opens the input side (the input-side terminal on the unconnected side is connected to the output-side terminal).

When the control signal SEL is "H", the output voltage Vpd2 of the analog switch 501 is applied to a hold capacitor 505 via the resistive element 503. The hold capacitor 505 is charged by a predetermined time constant $\tau$ when the voltage Vpd2 is applied to it. The hold capacitor 505 changes the voltage in accordance with the amount of charges accumulated by charging. In the turn-on state in which the LD1 is on, the hold capacitor 505 outputs a voltage corresponding to the light power monitor voltage Vpd. When the control signal SEL switches to "L", the input side of the analog switch 504 is opened, and as a result, the voltage of the charged hold capacitor 505 is held.

As described above, the analog switch 504 and the hold capacitor 505 are set in the sample state when the control signal SEL is "H", or in the hold state when "L". A voltage Vsh of the charged hold capacitor 505 is input to the current controller 506. Note that the time constant $\tau$ when charging the hold capacitor 505 is defined as $\tau$=RC depending on a resistance value R of the resistive element 503 and a capacitance C of the hold capacitor 505. When executing the APC, the hold capacitor 505 in the sample state is charged to a predetermined voltage Vt in the turn-off state in which the LD1 is off, or charged to the light power monitor voltage Vpd in the turn-on state in which the LD1 is on, as will be described later.

When the hold capacitor 505 is in the sample state, one of the reference voltage Vref and the light power monitor voltage Vpd corresponding to the light power detected by the PD in the semiconductor laser 43 is applied to the hold capacitor 505 in accordance with switching by the analog switch 501. That is, in this embodiment, the analog switch 501 functions as a switch for selectively applying one of the reference voltage Vref and the light power monitor voltage Vpd to the hold capacitor 505. The resistive element 503 functions as a resistive element connected between the switch and the hold capacitor 505. Additionally, in this embodiment, the analog switch 501, the resistive element 503, and the analog switch 504 function as a charging unit.

The current controller 506 decides the value of the switching current Isw based on the received reference voltage Vref and the voltage Vsh of the hold capacitor 505. The current controller 506 outputs the current control signal Isw corresponding to the decided value of the switching current Isw to the switching current source 404 (404-1 to **404-*n*). More specifically, when the LD1 changes from the turn-off state to the turn-on state, and optical scanning of the photosensitive member 11 by the laser beam output from the LD1 starts, the APC circuit 403 controls the voltage of the hold capacitor 505 in the following way. That is, the APC circuit 403 controls the driving current to be supplied from the switching current source 404-1 to the LD1 using the predetermined voltage Vt generated in the turn-off state as the initial value, thereby controlling the voltage of the hold capacitor 505. The current controller 506 designates the driving current to be supplied from the switching current source 404-1 to the LD1 by outputting the decided switching current value Isw (Isw-1) to the switching current source 404-1**.

As described above, the hold capacitor 505 functions as a charge accumulation unit which causes the laser light source (LD) to output a laser beam of a light power corresponding to the accumulated charge amount. That is, the hold capacitor 505 functions as a voltage holding unit which outputs a voltage corresponding to the accumulated charge amount. The current controller 506 and the switching current source 404-1 function as a current supply unit which supplies a driving current corresponding to the voltage of the charge accumulation unit (hold capacitor 505) to the laser light source (LD) when optical scanning of the photosensitive member 11 starts. The current controller 506 also functions as a control unit which controls the voltage of the charge accumulation unit (hold capacitor 505).

<Comparative Example of APC in Laser Driving Device 31>

A comparative example of APC in the laser driving device 31 according to this embodiment will be described next with reference to FIG. 7. For the sake of descriptive simplicity, APC by the APC circuit 403 (APC circuit 403-1) for the LD1 will only be explained below. For the remaining lasers (LD2 to LDn) as well, the APC can be implemented by performing the same control as that of the LD1.

When executing APC for an LD included in the laser driving device 31, if the light power of the LD is controlled after turning on the LD in the turn-off state, a considerable time may be necessary until the light power sufficiently approaches the target light power. FIG. 7 shows an example of the light emission sequence of the laser driving device 31 as a comparative example to the embodiment to be described below. In FIG. 7, an operation mode including APC to be performed before the image forming apparatus 100 starts image formation will be referred to as an "initial APC mode", and an operation mode including APC to be performed after image formation will be referred to as a "normal APC mode". FIG. 7 shows the light emission sequence for two LDs (LD1 and LD2) out of the LDs included in the laser driving device 31. The LD1 is an LD used to detect a BD signal and is assumed to be an LD for which the APC is executed first out of the plurality of LDs.

Figure 7:
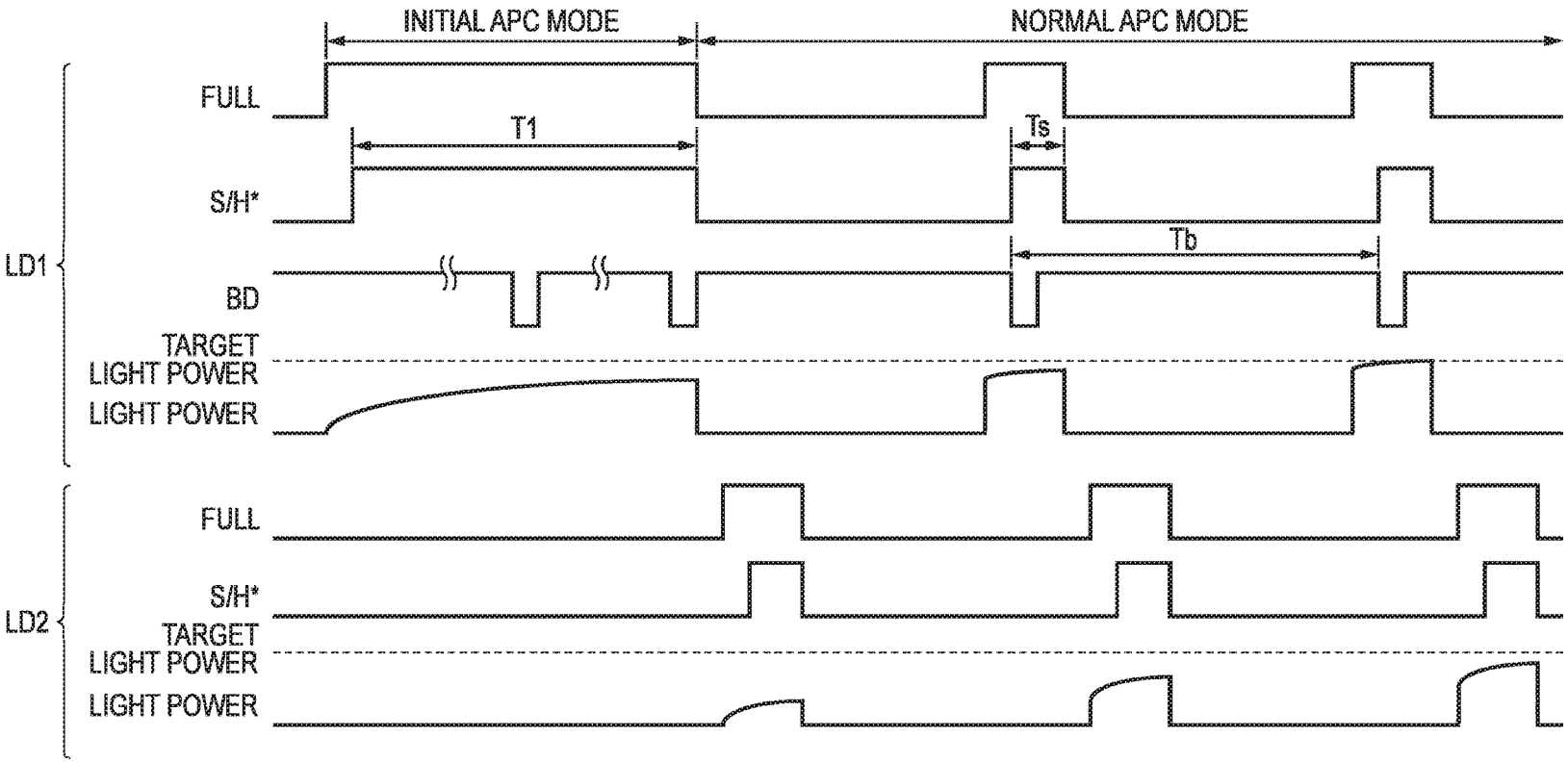
FIG. 7 is a timing chart showing a comparative example of the light emission sequence of the laser driving device 31.

Referring to FIG. 7, first, to start the APC of the initial APC mode, the sequence controller 47 switches the full turn-on signal FULL of the LD1 from "L" to "H" to turn on the LD1. In addition, the sequence controller 47 switches the sample hold signal S/H* (S/H*-1) of the LD1 from "L" to "H" to shift to a state to sample the light power of the LD1 detected by the PD. In this state, the detected light power of the LD1 gradually increases. This is because the sequence controller 47 controls the driving current to be supplied to the LD1 such that the detected light power of the LD1 approaches the target light power.

More specifically, the light power monitor voltage Vpd corresponding to the light power of the LD1 detected by the PD in the semiconductor laser 43 is input to the APC circuit 403. If the APC circuit 403 is in the sample state, the hold capacitor 505 is charged to the light power monitor voltage Vpd. The current controller 506 compares the light power monitor voltage Vpd generated in the hold capacitor 505 with the reference voltage Vref corresponding to the target light power. In addition, the current controller 506 decides the value of the switching current Isw based on the comparison result such that the light power monitor voltage Vpd approaches the reference voltage Vref. The value of the switching current Isw is output from the APC circuit 403 to the switching current source 404-1 as a current control signal (Isw-1). The switching current source 404-1 supplies the switching current Isw having a value corresponding to the current control signal (Isw-1) to the LD1. During the sample state, the APC circuit 403 continuously controls the switching current value Isw based on the light power monitor voltage Vpd and the reference voltage Vref. The sequence controller 47 thus controls the light power of the LD1 to the target light power using the APC circuit 403.

When the light power of the LD1 has sufficiently approached the target light power, and it has become possible to stably detect the BD signal, the sequence controller 47 ends the initial APC mode and shifts to the normal APC mode. When APC of the normal APC mode starts, the sequence controller 47 sets the LD1 in a full turn-on state for a predetermined period Ts and samples the light power every time a BD signal is detected (in every scanning). The sequence controller 47 thus executes the APC by controlling the driving current to the LD1 such that the light power of the LD1 approaches the target light power, as in the above-described initial APC mode. The light power of the LD1 has been made to sufficiently approach the target light power by the APC of the initial APC mode. Hence, in the APC of the normal APC mode executed after the initial APC mode, the light power of the LD1 can be made to reach the target light power by several times of APC executed every time a BD signal is detected.

In the APC of the initial APC mode described above, however, the driving current of, for example, the LD1 is gradually increased from 0, thereby gradually making the light power of the LD1 approach the target light power. For this reason, a relatively long time T1 is necessary until the light power of the LD1 sufficiently approaches the target light power and it becomes possible to stably detect the BD signal, as shown in FIG. 7.

In addition, a longer time is necessary for the LD2 after the driving current is supplied to turn on the LD2 until its light power sufficiently approaches the target light power. As shown in FIG. 7, after the shift from the initial APC mode to the normal APC mode, the sequence controller 47 switches the full turn-on signal FULL of the LD2 from "L" to "H" to turn on the LD2. In addition, the sequence controller 47 switches the sample hold signal S/H* from "L" to "H" to sample the light power of the LD2, and performs control to make the light power of the LD2 approach the target light power, thereby performing the APC of the LD2. After that, light power control of the LD2 is repetitively performed next to the light power control of the LD1 at a period Tb of BD signal detection.

In this manner, after the APC of the initial APC mode for the LD1 has ended, the APC for the LD2 is performed in the normal APC mode by performing control to make the light power of the LD2 gradually approach the target light power from the turn-off state. For this reason, the time until the light power of the LD2 reaches the target light power is longer than that of the LD1. Hence, in the image forming apparatus of the multi-beam system that exposes the photosensitive member by laser beams emitted by a plurality of LDs, the time until the light powers of all of the plurality of LDs are controlled to the target light power by the APC (initial APC mode and normal APC mode) becomes longer as a whole. For example, a time T2 necessary after the light power control of the LD2 has started until the light power reaches the target light power is approximately Tb×T1/Ts. For example, assume that T1=10 [ms], Ts=10 [μs], and Tb=500 [μs]. In this case, T2=500 [ms]. In the image forming apparatus of the multi-beam system, when the number of LDs increases, the time until the light powers of all LDs reach the target light power prolongs in proportional to the number of LDs.

The image forming apparatus according to this embodiment, when executing APC of the initial APC mode for the laser driving device 31, enables light power control to starts from a light power close to the target light power in order to make the light power of the LD approach the target light power in a short time after turning on the LD. More specifically, the hold capacitor that holds the voltage used to cause the LD to output a laser beam is charged in advance to a predetermined voltage close to the reference voltage for the target light power during the turn-off state (before turning on) of the LD before the start of optical scanning of the photosensitive member 11. That is, charges in a predetermined amount corresponding to the predetermined voltage close to the reference voltage for the target light power are accumulated in the hold capacitor during the turn-off state of the LD before the start of optical scanning. The voltage of the hold capacitor is used to decide the driving current to be supplied to the LD based on the result of comparison with the reference voltage. In this embodiment, since the hold capacitor has been charged in advance to the voltage close to the reference voltage when turning on the LD and starting the light power control of the LD, the LD can be turned on in a light power close to the target light power at the start of APC of the initial APC mode. This allows the light power of the LD to reach the target light power in a short time by the APC of the initial APC mode and the normal APC mode.

This embodiment assumes an image forming apparatus of the multi-beam system. In the image forming apparatus of the multi-beam system, for each of the LDs, charges in a predetermined amount are accumulated in a corresponding hold capacitor during the turn-off state before the start of optical scanning, thereby charging the hold capacitor to a predetermined voltage. This allows all LDs to make the light power reach the target light power in a short time by the APC after turn on. Processing executed for the laser driving device 31 in this embodiment will be described below in more detail.

<APC in Laser Driving Device 31>

APC in the laser driving device 31 according to this embodiment will be described next with reference to FIG. 4. For the sake of descriptive simplicity, APC by the APC circuit 403 (APC circuit 403-1) for the LD1 will only be explained below. For the remaining lasers (LD2 to LDn) as well, the APC can be implemented by performing the same control as that of the LD1.

In the image forming apparatus 100, the APC executed for light power control of each of the LD1 to LDn is divided into APC of the initial APC mode and APC of the normal APC mode, as described above. The initial APC mode is an operation mode including APC to be performed as a preparation operation before the image forming apparatus 100 starts image formation. In the APC of the initial APC mode, control is performed from a complete turn-off state of each LD such that the light power of the laser beam emitted by each LD approaches the target light power. The normal APC mode is an operation mode including APC to be performed after the start of image formation. In the APC of the normal APC mode, the light power of the laser beam emitted by each LD to expose the photosensitive member 11 is controlled to the target light power.

The initial APC mode of this embodiment includes an initial charging operation of charging the hold capacitor 505 to the predetermined voltage Vt in the turn-off state in which each LD is off before the start of driving current supply to each LD. The initial charging operation need only be executed, for example, at the time of activation of the image forming apparatus 100 or at the time of a preparation operation before the start of formation of an image to be transferred to a recording material. Assume here that the initial charging operation is executed at the time of a preparation operation of the image forming apparatus 100.

In the initial APC mode of this embodiment, the APC to control the light power of each LD to a light power near a predetermined target light power is executed in the turn-on state in which each LD is on, after the initial charging operation has ended and driving current supply to each LD has started. In this APC, when supply of the driving current (switching current) to each LD starts, the hold capacitor 505 is charged from the voltage Vt to the light power monitor voltage Vpd corresponding to the light power detected by the PD. In addition, the switching current is controlled based on the result of comparison between the reference voltage Vref and the light power monitor voltage Vpd generated in the hold capacitor 505. In this APC, the light power monitor voltage Vpd is controlled to approach the reference voltage Vref from not voltage=0 but the voltage Vt close to the reference voltage Vref corresponding to the target light power, as will be described later. That is, control of the driving current (light power) based on the light power monitor voltage Vpd (corresponding to the light power of each LD) is started from the voltage Vt close to the reference voltage Vref, thereby controlling the light power of each LD to the target light power in a shorter time. After that, when the image forming apparatus 100 has started image formation, the initial APC mode changes to the normal APC mode, and APC of the normal APC mode is executed at a predetermined timing. The initial charging operation in the initial APC mode and the APC of the initial APC mode and the normal APC mode will be described below in detail in accordance with the light emission sequence shown in FIG. 4.

(Initial Charging Operation in Initial APC Mode)

In the initial state before the start of image formation in the image forming apparatus 100 (before a time 421 in FIG. 4), the sequence controller 47 outputs the signal OFF_LD of "H". In this state, the switch 408-1 is off, and the bias current and the switching current to the LD1 are not supplied. Hence, since the LD1 is in the turn-off state, the light power monitor voltage Vpd input to the APC circuit 403 is 0. Additionally, in the initial state, the sequence controller 47 outputs the sample hold signal S/H* of "H" and the control signal OFF_APC* of "H" to the APC circuit 403.

At the time 421, the sequence controller 47 changes the control signal OFF_APC* from "H" to "L". Accordingly, the analog switch 501 outputs not the light power monitor voltage Vpd but the reference voltage Vref as the output voltage Vpd2. In addition, since the control signal OFF_APC* is "H", and the sample hold signal S/H* is "L", the control signal SEL is set to "H". For this reason, the analog switch 504 sets the hold capacitor 505 in the sample state. Hence, at the time 421, the reference voltage Vref (=voltage Vpd2) starts being applied to the hold capacitor 505 via the resistive element 503.

Figure 4:
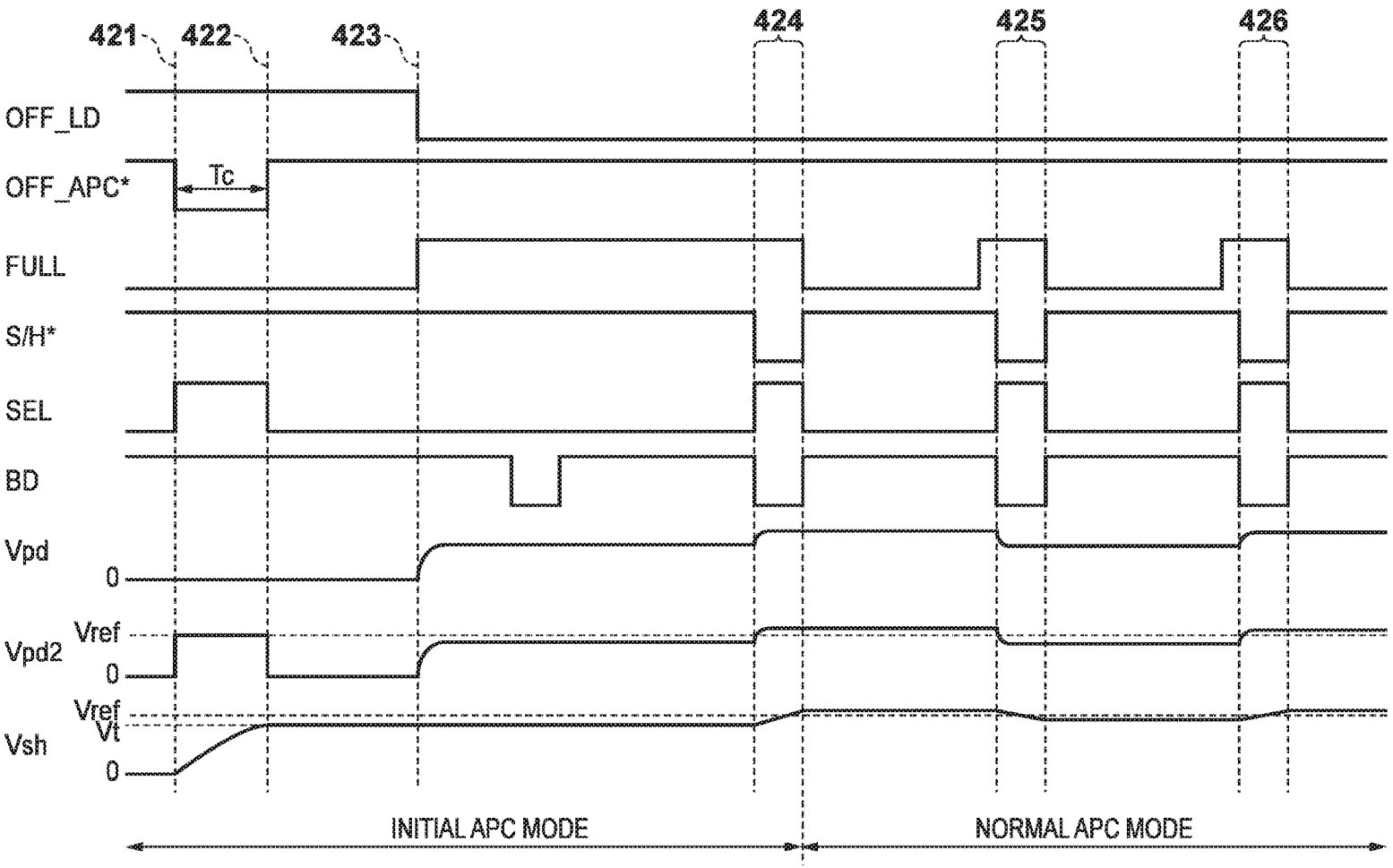
FIG. 4 is a timing chart showing the light emission sequence of the laser driving device 31 according to the embodiment of the present invention.

The reference voltage Vref is applied to the hold capacitor 505 for a predetermined period Tc (the period from the time 421 to a time 422 in FIG. 4). The period Tc is defined as a period after the charging of the hold capacitor 505 by the reference voltage Vref has started until the hold capacitor 505 is charged to the predetermined voltage Vt. At the time 422, the sequence controller 47 changes the control signal OFF_APC* from "L" to "H". Accordingly, the control signal SEL changes from "H" to "L", and the analog switch 504 changes the hold capacitor 505 to the hold state. As a result, at the time 422, the hold capacitor 505 is charged to the predetermined voltage Vt by the time constant τ and held at the voltage. After that, at a time 423, the initial charging operation ends, and the processing switches to execution of APC of the initial APC mode.

(Setting of Period Tc)

Figure 5:
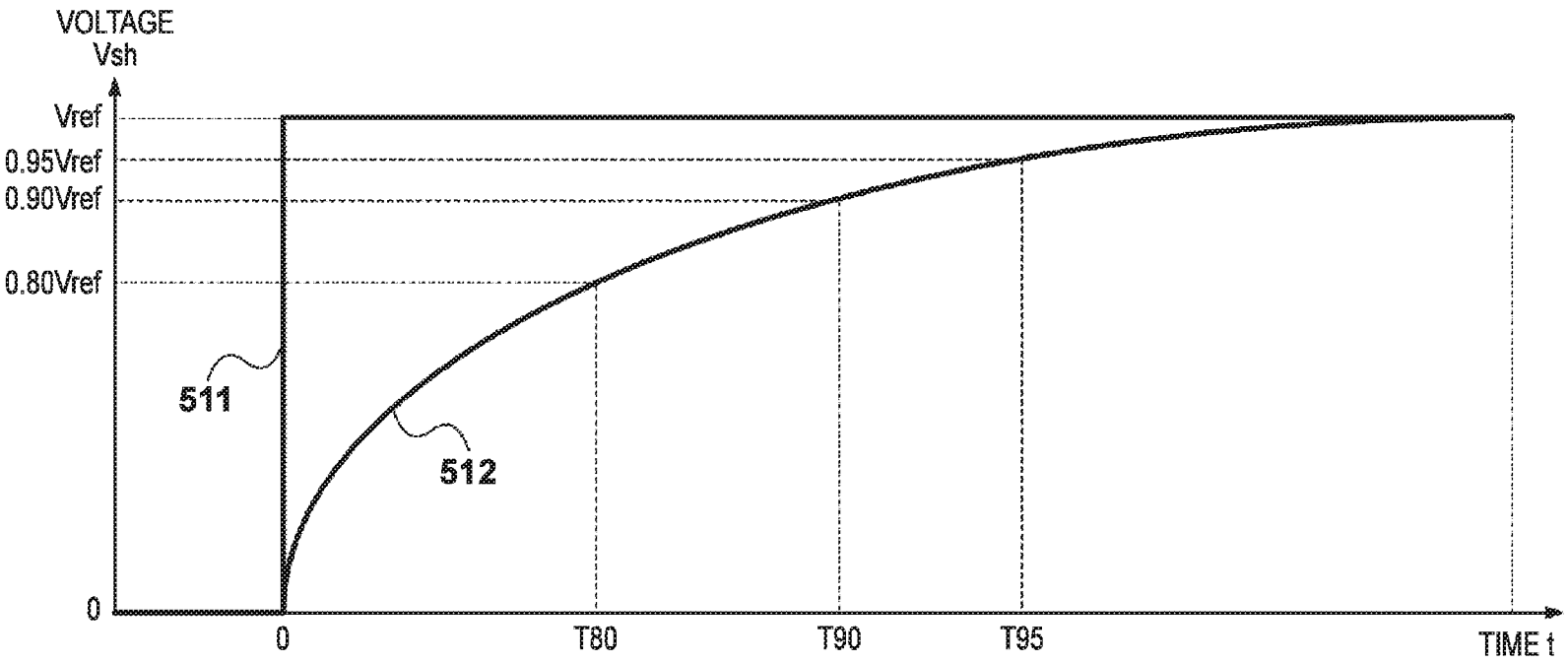
FIG. 5 is a timing chart showing the relationship between an input voltage and an output voltage Vsh of a hold capacitor 505 according to the embodiment of the present invention.

The period Tc will be explained here with reference to FIG. 5. Referring to FIG. 5, a waveform 511 represents the output voltage Vpd2 of the analog switch 501, and has a step at time t=0 corresponding to the time 421 at which the voltage switches from 0 to the reference voltage Vref. A waveform 512 represents the voltage Vsh of the hold capacitor 505 when the reference voltage Vref is applied to the hold capacitor 505 via the resistive element 503. The hold capacitor 505 accumulates charges as the reference voltage Vref is applied to the hold capacitor 505 via the resistive element 503. As a result, the voltage Vsh of the hold capacitor 505 moderately increases with the time constant τ defined by the capacitance C of the hold capacitor 505 and the resistance value R of the resistive element 503.

The voltage Vsh (waveform 512) of the hold capacitor 505 shown in FIG. 5 is the step response to the waveform 511 and is generally given by $$Vsh = V\mathrm{ref}(1-\exp(-t/\tau)) \quad (1)$$

When the time t at which the voltage Vsh reaches the predetermined voltage Vt is defined as Tc, Tc is determined depending on the reference voltage Vref, the voltage Vt, and the time constant τ, as is apparent.

The voltage Vt may be designated in advance at a ratio to the reference voltage Vref. That is, the voltage Vt may be designated as a ratio x (%) of the light power to the voltage Vt based on the target light power. In this case, using the ratio x, the period Tc during which the hold capacitor 505 is charged is obtained by $$Tc = -\tau \times \ln(1-x/100) \quad (2)$$

The period Tc can be calculated by equation (2) using the ratio x and the time constant τ. Note that Tc may be calculated by the sequence controller 47. The sequence controller 47 switches the control signal OFF_APC* such that the reference voltage Vref is applied to the hold capacitor 505 during the calculated period Tc.

FIG. 5 shows a case in which the ratio x is set to 80, 90, and 95(%) as an example. Using equation (2), $$x=80(\%), Tc(T80)=1.61\tau$$

$$x=90(\%), Tc(T90)=2.30\tau$$

$$x=95(\%), Tc(T95)=2.97\tau$$

are obtained. As can be seen from FIG. 5, when the ratio x is increased, the period Tc until the voltage Vsh reaches the voltage (0.80 Vref, 0.90 Vref, 0.95 Vref) corresponding to the ratio x becomes long. Hence, the closer the light power from which light power control by APC executed after the initial charging operation starts is to the target light power, the longer the period Tc necessary for charging the hold capacitor 505 in the initial charging operation is. It is therefore necessary to set the period Tc within a period assignable to the initial charging operation. Note that the period Tc designated by the ratio x is constant independently of the target light power even when the target light power is changed, as indicated by equation (2).

(APC of Initial APC Mode and Normal APC Mode)

When the above-described initial charging operation is completed in the image forming apparatus 100, the processing shifts to execution of APC of the initial APC mode at the time 423. At the time 423, the sequence controller 47 switches the signal OFF_LD from "H" to "L" to start supplying the driving current to each LD, thereby setting each LD in the turn-on state. At this time, the current controller 506 in the APC circuit 403 decides the driving current (switching current value Isw) to be supplied to each LD in accordance with the voltage Vsh (=Vt) of the hold capacitor 505 charged in the turn-off state of the LD.

The hold capacitor 505 has been charged up to the voltage Vt close to the reference voltage Vref corresponding to the target light power by the initial charging operation in the initial APC mode, as shown in FIG. 4. Hence, the decided driving current has a current value close to the driving current corresponding to the target light power. As a consequence, the light power of each LD is controlled to the target light power in a short time by several times of APC executed later in response to detection of a BD signal. Referring to FIG. 4, after the time 423, the sequence controller 47 sets each LD in the full turn-on state and detects the BD signal. In addition, the sequence controller 47 switches the sample hold signal S/H* (H→L) to switch the hold capacitor 505 from the hold state to the sample state at the timing the BD signal has stably been detected twice. The first APC of the initial APC mode is thus executed during a period 424, and the voltage of the hold capacitor 505 approaches the reference voltage Vref corresponding to the target light power from the voltage Vt (initial value).

After that, when the APC during the period 424 is completed, and image formation starts, the image forming apparatus 100 shifts from the initial APC mode to the normal APC mode. In every scanning of the photosensitive member 11 by a laser beam output from each LD (every time a BD signal is detected), the APC operation is repetitively performed during a predetermined period (periods 425 and 426). In FIG. 4, the voltage Vsh of the hold capacitor 505 is set to a value sufficiently closer to the reference voltage Vref during the periods 425 and 426. That is, the light power of each LD is controlled to a light power sufficiently close to the target light power, and the light power is considered to have reached the target light power.

FIG. 4 illustrates only the light emission sequence of one LD. In this embodiment, the same light emission sequence is executed for n LDs (LD1 to LDn). As described above, the APC circuits 403 (403-1 to **403-*n*) are provided for the n LDs, respectively. Hence, the light emission sequence shown in FIG. 4** is executed for each LD.

<Procedure of APC in Laser Driving Device 31>

Figure 6:
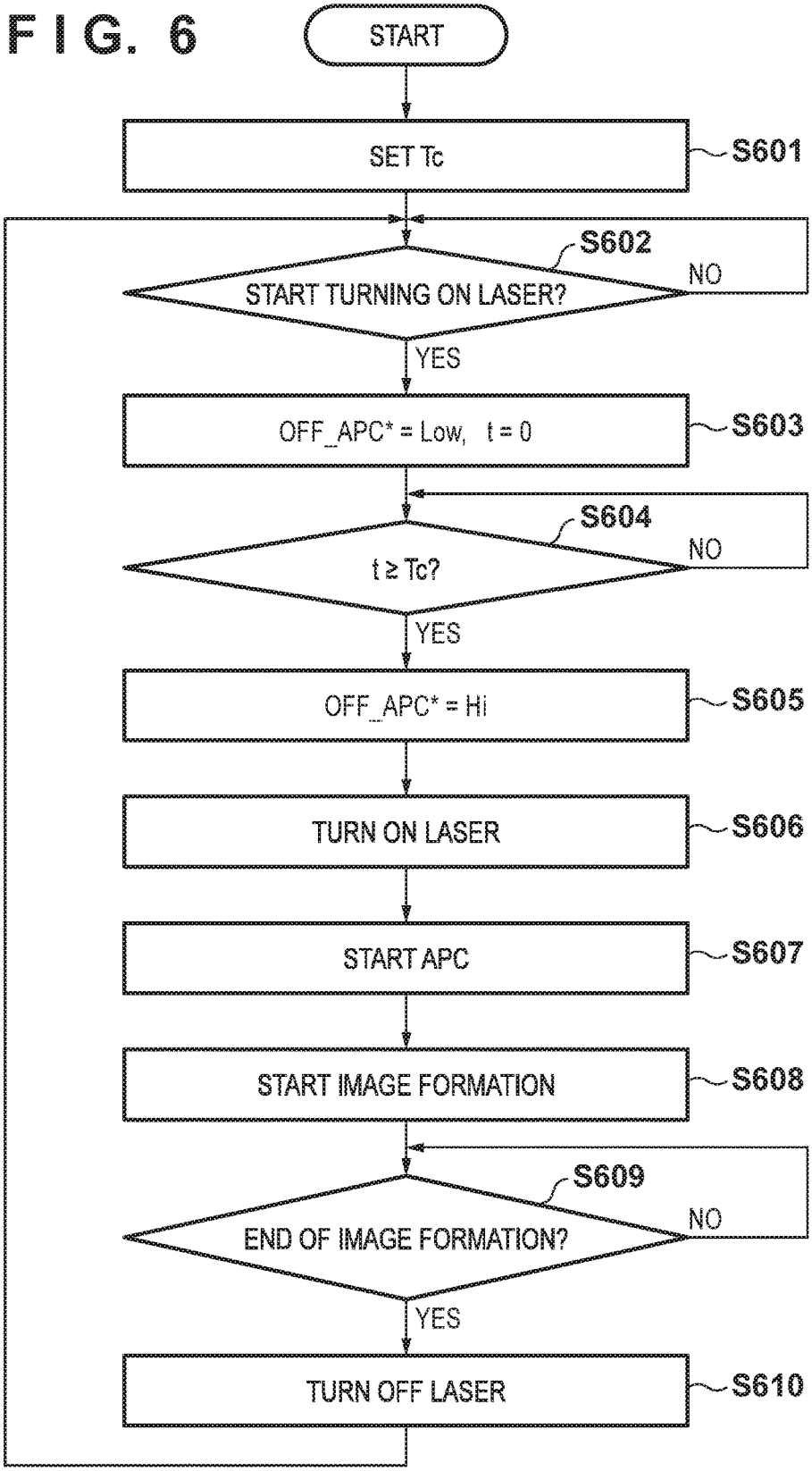
FIG. 6 is a flowchart showing the procedure of an APC operation executed for the laser driving device 31 according to the embodiment of the present invention.

The procedure of the series of APC operations (initial APC mode and normal APC mode) in the laser driving device 31 described with reference to FIGS. 4 and 5 will be explained next with reference to the flowchart of FIG. 6. Note that the processing of each step shown in FIG. 6 is implemented on the image forming apparatus 100 by causing the CPU (not shown) of the sequence controller 47 to read out a control program stored in advance in a memory or the like to a RAM (not shown) and execute the program. The sequence controller 47 is assumed to start the processing shown in FIG. 6 upon power-on of the image forming apparatus 100 and end the processing upon power-off.

In step S601, the CPU of the sequence controller 47 (to be simply referred to as a "CPU" hereinafter) sets the period Tc based on, for example, an instruction input by the user via the operation unit (not shown) of the image forming apparatus 100 before the start of image formation. The period Tc can be set based on equation (1) or (2), as described above. That is, the CPU controls the operation unit such that the user can set the ratio x (%). After that, the CPU advances the process to step S602.

In step S602, the CPU determines whether to start image formation. In accordance with input of an image formation command, or the like, the CPU determines whether to start image formation. Upon determining in step S602 not to start image formation, the CPU repeats the determination of step S602. Upon determining in step S602 to start image formation, the process advances to step S603.

In step S603, the CPU starts the above-described initial APC mode and also starts the initial charging operation. That is, the CPU starts the operation of charging the hold capacitor 505 to the voltage Vt based on the ratio x in the turn-off state without turning on the lasers. More specifically, the CPU switches the control signal OFF_APC* to be output to the APC circuit 403 from "H" to "L", and starts time count from time t=0. In step S604, the CPU determines whether the period Tc has elapsed after the switching of the control signal OFF_APC* in step S603 (t≥Tc is satisfied). Upon determining that the period Tc has elapsed, the CPU advances the process to step S605 to return the control signal OFF_APC* from "L" to "H". The hold capacitor 505 is thus charged from the voltage 0 to the voltage Vt (the voltage corresponding to x % of the reference voltage Vref corresponding to the target light power).

In step S606, the CPU starts driving the polygon mirror 33 and also starts supplying the driving current to each of the lasers (LD1 to LDn), thereby turning on the lasers and setting them in the full turn-on state. The image forming apparatus 100 thus starts the APC (of the initial APC mode). When a BD signal is detected as the BD sensor 36 receives the laser beam from a representative laser, the CPU starts the APC of each LD in step S607 (period 424 in FIG. 4).

In step S608, the CPU starts supplying a driving current (switching current) based on the image information to each laser, thereby stating image formation. The image forming apparatus 100 thus shifts from the initial APC mode to the normal APC mode. After the start of image formation, the CPU may execute the APC (of the normal APC mode) in response to BD signal detection using a laser beam. In step S609, the CPU determines whether processing designated by the image formation command is completed, thereby determining whether to end the image formation. As long as determining not to end the image formation processing, the CPU repeats the determination of step S609. Upon determining to end, the process advances to step S610. In step S610, the CPU turns off the lasers, and returns the process to step S602. The image forming apparatus 100 stands by until image formation starts again.

As described above, when performing APC for an LD that outputs a laser beam corresponding to the driving current controlled based on the voltage of the hold capacitor, the optical scanning apparatus according to this embodiment controls the driving current to be supplied to the LD such that the light power monitor voltage generated in the charged hold capacitor approaches the reference voltage from the initial value that is a voltage corresponding to the amount of charges accumulated in the hold capacitor in advance at the time of turning on the LD. The hold capacitor accumulates charges in advance in a state in which the LD is off before the start of optical scanning of the photosensitive member. When the LD is turned on, the hold capacitor outputs a voltage corresponding to the amount of charges accumulated in advance at the time of turning on the LD, and then outputs a voltage corresponding to the light power of the LD. The optical scanning apparatus thus controls the driving current (that is, the voltage of the hold capacitor) to be supplied to the LD such that the voltage corresponding to the light power of the LD approaches the reference voltage from the initial value that is the voltage corresponding to the amount of charges accumulated in the hold capacitor in advance before turning on the LD. According to this embodiment, the voltage of the hold capacitor can approach the reference voltage from a voltage closer to the reference voltage corresponding to the target light power as compared to a case in which no charges are accumulated in the hold capacitor in advance. That is, when executing the APC, the light power of the LD can be made to approach the target light power in a shorter time after turning on the LD.

More specifically, the optical scanning apparatus may charge the hold capacitor to a predetermined voltage close to the reference voltage corresponding to the target light power before turning on the LD. When performing the APC, the voltage of the hold capacitor approaches the reference voltage from the predetermined voltage set as the initial value. That is, since the light power control of the LD can be started from the level close to the target light power after turning on the LD, it is possible to control the light power to the target light power in a short time.

Note that in the image forming apparatus according to this embodiment, the target light power is the light power of the laser beam input to the BD sensor 36. The light power that enters the BD sensor 36 is desired to be constant. The rising speed and falling speed of the signal output from the BD sensor 36 depend on the light power of the laser beam that enters the BD sensor 36. That is, when the light power that enters the BD sensor 36 changes, the rising speed and falling speed of the signal output from the BD sensor 36 change depending on the light power of the laser beam. For this reason, to always attain the same image write position, the light power of the laser beam that enters the BD sensor 36 is desired to be made constant.

On the other hand, the light power of the laser beam to expose the surface of the photosensitive member 11 to form an electrostatic latent image on the photosensitive member 11 is controlled in the following way. The image forming apparatus according to this embodiment is provided with the potential sensor 30 to measure the charges on the surface of the photosensitive member 11. The sequence controller 47 performs control to expose, by a plurality of light powers of laser beams, the photosensitive member 11 charged by the primary charger 28 at a predetermined timing, thereby forming a plurality of latent image patterns on the photosensitive member 11. The potential of each of the plurality of latent image patterns is detected by the potential sensor 30. The sequence controller 47 selects a latent image pattern formed with a predetermined potential out of the plurality of latent image patterns, and sets the light power of the laser beam corresponding to the latent image pattern to the light power of the laser beam to expose the surface of the photosensitive member 11. Note that a density sensor may be attached to the image forming apparatus, and the light power of the laser beam to expose the surface of the photosensitive member 11 may be set based on not the latent image patterns but toner patterns of a plurality of densities.

The light power control signal included in the control signal S47 is a signal (control coefficient) representing the degree of control of the light power of the laser beam to scan the surface of the photosensitive member 11 with respect to the target light power. The sequence controller 47 outputs the light power control signal to the current controller 506 of the APC circuit 403. The current controller 506 controls the switching current Isw such that the light power of the laser beam to scan the surface of the photosensitive member 11 is controlled to a light power obtained by multiplying the target light power (a light power corresponding to Vref) by the control coefficient.

That is, the image forming apparatus according to this embodiment controls the light power of the laser beam that enters the BD sensor 36 to the target light power (first light power). On the other hand, the image forming apparatus according to this embodiment controls the light power of the laser beam to scan the surface of the photosensitive member 11 to form a latent image pattern on the photosensitive member 11 to a second light power based on the target light power and the detection result of the potential sensor.

In this embodiment, for each of the plurality of LDs of the image forming apparatus of the multi-beam system, the corresponding hold capacitor is charged to a predetermined voltage in advance before turning on the LDs. This allows to the light power control to start from the level close to the target light power for all of the plurality of LDs. Hence, according to this embodiment, it is possible to shorten the time necessary until the light power reaches the target light power by the APC, which is particularly problematic in the image forming apparatus of the multi-beam system.

While the present invention has been described with reference to embodiments, it is to be understood that the invention is not limited to the disclosed embodiments.

This application claims the benefit of Japanese Patent Application Nos. 2011-269394, filed Dec. 8, 2011 and 2012-250587, Nov. 14, 2012, which are hereby incorporated by reference herein in their entirety.

What is claimed is:

1. An image forming apparatus comprising:

a photosensitive member;

first and second light sources each configured to output a light beam having a light power based on a supplied driving current;

a detection unit, including a light receiving element arranged at a position where a light beam output from each of the first and second light sources is received, configured to generate, as a detection result, a detection voltage corresponding to the light power of the light beam received by the light receiving element;

first and second capacitors that respectively correspond to the first and second light sources; and a driving unit configured to control a voltage of each of the first and second capacitors, and to supply, to the first light source, a driving current corresponding to the voltage of the first capacitor and supply, to the second light source, a driving current corresponding to the voltage of the second capacitor, wherein the driving unit is configured to:

charge the first and second capacitors in parallel without using the detection result by the detection unit, and stop charging the first and second capacitors in accordance with the charging having been executed for a predetermined time;

control the voltage of the first capacitor charged without using the detection result, based on the detection voltage that is generated by the detection unit when the light receiving element receives the light beam output from the first light source to which the driving current corresponding to the voltage of the first capacitor is supplied, and control the voltage of the second capacitor charged without using the detection result, based on the detection voltage that is by the detection unit when the light receiving element receives the light beam output from the second light source to which the driving current corresponding to the voltage of the second capacitor is supplied; and supply, to the first light source, the driving current corresponding to the voltage of the first capacitor that has been controlled based on the detection voltage and supply, to the second light source, the driving current corresponding to the voltage of the second capacitor that has been controlled based on the detection voltage, so as to cause each of the first and second light sources to output the light beam for exposing the photosensitive member, wherein the driving unit is configured to further charge the first capacitor that has been charged for the predetermined time without using the detection result by the detection unit, based on the detection voltage corresponding to the light beam output from the first light source, and to further charge the second capacitor that has been charged for the predetermined time without using the detection result by the detection unit, based on the detection voltage corresponding to the light beam output from the second light source.

2. The image forming apparatus according to claim 1, wherein the driving unit is configured not to supply the driving current corresponding to the first capacitor to the first light source and not to supply the driving current corresponding to the second capacitor to the second light source, while charging the first and second capacitors in parallel without using the detection result by the detection unit.

3. The image forming apparatus according to claim 1, further comprising a control unit configured to output, to the driving unit, a signal for causing the driving unit to perform a mode to charge the first and second capacitors in parallel without using the detection result by the detection unit, and a signal for causing the driving unit to perform a mode to control the voltage of each of the first and second capacitors based on the detection voltage generated by the detection unit.

4. An image forming apparatus comprising:

a photosensitive member;

first and second light sources each configured to output a light beam having a light power based on a supplied driving current;

a detection unit, including a light receiving element arranged at a position where a light beam output from each of the first and second light sources is received, configured to generate, as a detection result, a detection voltage corresponding to the light power of the light beam received by the light receiving element;

a comparison unit configured to compare the detection voltage and a reference voltage corresponding to a target light power;

first and second capacitors that respectively correspond to the first and second light sources; and a driving unit configured to control a voltage of each of the first and second capacitors, and to supply, to the first light source, a driving current corresponding to the voltage of the first capacitor and supply, to the second light source, a driving current corresponding to the voltage of the second capacitor, wherein the driving unit is configured to:

charge the first and second capacitors in parallel without using the detection result by the detection unit, and stop charging the first and second capacitors in accordance with the charging having been executed for a predetermined time;

control the voltage of the first capacitor charged without using the detection result, based on the detection voltage that is generated by the detection unit when the light receiving element receives the light beam output from the first light source to which the driving current corresponding to the voltage of the first capacitor is supplied, and control the voltage of the second capacitor charged without using the detection result, based on the detection voltage that is by the detection unit when the light receiving element receives the light beam output from the second light source to which the driving current corresponding to the voltage of the second capacitor is supplied; and supply, to the first light source, the driving current corresponding to the voltage of the first capacitor that has been controlled based on the detection voltage and supply, to the second light source, the driving current corresponding to the voltage of the second capacitor that has been controlled based on the detection voltage, so as to cause each of the first and second light sources to output the light beam for exposing the photosensitive member, wherein the driving unit is configured to:

control the voltage of the first capacitor in accordance with a comparison result by the comparison unit such that the detection voltage corresponding to the light beam output from the first light source approaches the reference voltage; and control the voltage of the second capacitor in accordance with a comparison result by the comparison unit such that the detection voltage corresponding to the light beam output from the second light source approaches the reference voltage, wherein the driving unit comprises a first driver configured to control the driving current to be supplied to the first light source in accordance with the voltage of the first capacitor, and a second driver configured to control the driving current to be supplied to the second light source in accordance with the voltage of the second capacitor, wherein each of the first and second drivers comprises:

a switch configured to selectively apply one of the reference voltage and the voltage corresponding to the detection voltage to the capacitor; and a resistive element connected between the switch and the capacitor, wherein the predetermined period is determined depending on the reference voltage, a predetermined voltage to which the capacitor is charged, and a time constant determined by a capacitance of the capacitor and a resistance value of the resistive element.

5. The image forming apparatus according to claim 4, wherein the driving unit is configured not to supply the driving current corresponding to the first capacitor to the first light source and not to supply the driving current corresponding to the second capacitor to the second light source, while charging the first and second capacitors in parallel without using the detection result by the detection unit.

6. The image forming apparatus according to claim 4, further comprising a control unit configured to output, to the driving unit, a signal for causing the driving unit to perform a mode to charge the first and second capacitors in parallel without using the detection result by the detection unit, and a signal for causing the driving unit to perform a mode to control the voltage of each of the first and second capacitors based on the detection voltage generated by the detection unit.

* * * * *